US009082544B2

(12) United States Patent
Ikezawa

(10) Patent No.: US 9,082,544 B2
(45) Date of Patent: Jul. 14, 2015

(54) BOBBIN AND COIL COMPONENT

(71) Applicant: TDK CORPORATION, Tokyo (JP)

(72) Inventor: Akira Ikezawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 22 days.

(21) Appl. No.: 14/161,948

(22) Filed: Jan. 23, 2014

(65) Prior Publication Data

US 2014/0240070 A1 Aug. 28, 2014

(30) Foreign Application Priority Data

Feb. 22, 2013 (JP) ..... 2013-033661

(51) Int. Cl.
*H01F 27/30* (2006.01)
*H01F 27/28* (2006.01)

(52) U.S. Cl.
CPC ..... *H01F 27/306* (2013.01); *H01F 27/2847* (2013.01); *H01F 2027/2861* (2013.01)

(58) Field of Classification Search
CPC ... H01F 27/325; H01F 27/324; H01F 27/292; H01F 5/02; H01F 22/2847; H01F 17/041
See application file for complete search history.

(56) References Cited

U.S. PATENT DOCUMENTS

| | | | | |
|---|---|---|---|---|
| 5,010,314 | A * | 4/1991 | Estrov | 336/198 |
| 5,929,734 | A * | 7/1999 | Weiner | 336/61 |
| 6,630,880 | B2 * | 10/2003 | Cheung et al. | 336/198 |
| 6,727,793 | B2 * | 4/2004 | Piechnick | 336/198 |
| 6,734,775 | B2 * | 5/2004 | Chung | 336/198 |
| 7,091,817 | B2 * | 8/2006 | Peck et al. | 336/208 |
| 7,567,164 | B2 * | 7/2009 | Chin | 336/198 |
| 7,924,133 | B2 | 4/2011 | Kaneko | |

FOREIGN PATENT DOCUMENTS

JP A-2010-45187 2/2010

* cited by examiner

*Primary Examiner* — Alexander Talpalatski
*Assistant Examiner* — Joselito Baisa
(74) *Attorney, Agent, or Firm* — Oliff PLC

(57) ABSTRACT

To improve the insulation property of a coil winding wire without increasing the number of components. In a case where a coil winding wire 3 is inserted into a region formed by two side wall portions 41 and 42 and two connection portions 43 and 44 and this result is sandwiched between magnetic core members 6A and 6B, it is possible to prevent the two side wall portions 41 and 42 from contacting the coil winding wire 3 and the outer electronic components. Further, since the coil winding wire 3 is sandwiched by the connection portion 42 formed at the upper surface side of the coil winding wire 3 and the connection portion 44 formed at the lower surface side thereof from the upper and lower surfaces of the coil winding wire, the insulation property with respect to other electronic components in the up and down direction is also maintained.

7 Claims, 11 Drawing Sheets

BOBBIN AND COIL COMPONENT

TECHNICAL FIELD

The present invention relates to a bobbin and a coil component with the bobbin.

BACKGROUND

A coil winding wire that is used in a transformer of a switching power supply device assembled in an in-car battery charger or the like needs to be insulated from other electronic components. As a coil bobbin used for the insulation, for example, Japanese Patent Application Laid-Open No. 2010-45187 discloses a coil bobbin of which a main body portion is inserted into a coil winding wire and which has a protrusion portion protruding outward from the outer peripheral surface of the main body portion.

SUMMARY

However, in the coil bobbin disclosed in Japanese Patent Application Laid-Open No. 2010-45187, a transformer core inserted into a winding shaft of the coil winding wire is insulated and the transformer core is insulated at the bottom surface side of the coil winding wire, but the winding wire is exposed at the other surface of the coil winding wire. For this reason, a case may be considered in which the contact between the coil winding wires and the contact between the coil winding wire and other electronic components occurring in accordance with the strength or the direction of vibration or impact cannot be easily prevented. Further, an insulation member different from the coil bobbin may be further assembled in order to prevent the contact. However, in this case, the number of components increases, and hence the number of assembling processes or the component management cost increases.

The present invention is made in view of the above-described circumstances, and an object of the present invention is to provide a bobbin capable of improving an insulation property of a coil winding wire without increasing the number of components and a coil component in which a coil winding wire is attached to the bobbin.

In order to attain the above-described object, according to an aspect of the present invention, there is provided a bobbin including: at least two insulating side wall portions that are disposed so as to face each other with an axis interposed therebetween and extend in the axis direction; a first insulating connection portion that is formed along a plane perpendicular to the axis so as to connect the same side ends in the axis extension direction among the ends of the two side wall portions and has an opening formed in a region with the axis; and a second insulating connection portion that is formed along a plane perpendicular to the axis so as to connect the opposite side ends of the ends connected by the first connection portion among the ends of the two side wall portions, wherein the first connection portion includes an inner wall portion that is formed in a surface facing the second connection portion so as to extend in the axis direction from the peripheral edge of the opening, and wherein the inner wall portion in the axis direction is inclined so that the height thereof increases from one side toward the other side.

According to the bobbin, in a case where the coil winding wire is inserted into a region formed by the two side wall portions, the first connection portion, and the second connection portion and the result is sandwiched by the cores, it is possible to prevent the two side wall portions from contacting the coil winding wire and the outer electronic component. Further, since the coil winding wire is sandwiched by the first connection portion formed at the upper surface side of the coil winding wire and the second connection portion formed at the lower surface side thereof from the upper and lower surfaces of the coil winding wire, the insulation property of the coil winding wire with respect to the other electronic components in the up and down direction is maintained. Further, it is possible to insulate the inner wall portion formed in the first connection portion from the leg portion of the transformer core inserted into the opening. In addition, since the inner wall portion is inclined so that the height thereof increases from one side toward the other side, the coil winding wire may be inserted into the bobbin along the slope of the inner wall portion, and hence the workability may be improved. In this way, according to the bobbin, it is possible to improve the insulation property of the coil winding wire without increasing the number of components.

Here, the bobbin may further include a third insulating connection portion that is formed in a plane perpendicular to the axis so as to connect the two side wall portions at a position different from both ends of the two side wall portions.

In this way, since the third insulating connection portion is further provided, for example, in a case where the coil winding wire is wound by at least two turns, when the coil winding wire is inserted so that the third connection portion is sandwiched between the adjacent winding wires, the insulation property between the winding wires may be improved.

Further, the inner wall portion may include a protrusion portion that protrudes outward.

Accordingly, it is possible to appropriately position the coil winding wire by the use of the protrusion portion formed in the inner wall portion and to suppress the movement of the coil winding wire caused by the vibration or the like.

Further, according to another aspect of the present invention, there is provided a coil component including: a coil winding wire that is wound around the axis by at least one turn; and the above-described bobbin.

Further, according to still another aspect of the present invention, there is provided a coil component including: a coil winding wire that is wound around the axis by at least one turn; and the above-described bobbin, wherein the coil winding wire is formed by connecting a plurality of plate-shaped winding wires in the axis direction, forms an annular shape when viewed from the axis direction, and has a cut portion that is formed at the inner peripheral side thereof so as to protrude outward from the axis, and wherein the shape of the cut portion corresponds to the protrusion portion that is formed in the inner wall portion of the bobbin.

As described above, in a case where the coil winding wire is provided with the cut portion corresponding to the protrusion portion formed in the inner wall portion of the bobbin, the coil winding wire and the bobbin are attached so that the cut portion and the protrusion portion are fitted to each other during the assembly. As a result, it is possible to appropriately position the coil winding wire and to prevent the movement of the coil winding wire caused by the vibration or the impact.

According to the present invention, there are provided the bobbin capable of improving the insulation property of the coil winding wire without increasing the number of components and the coil component in which the coil winding wire is attached to the bobbin.

DETAILED DESCRIPTION

Figure 1:
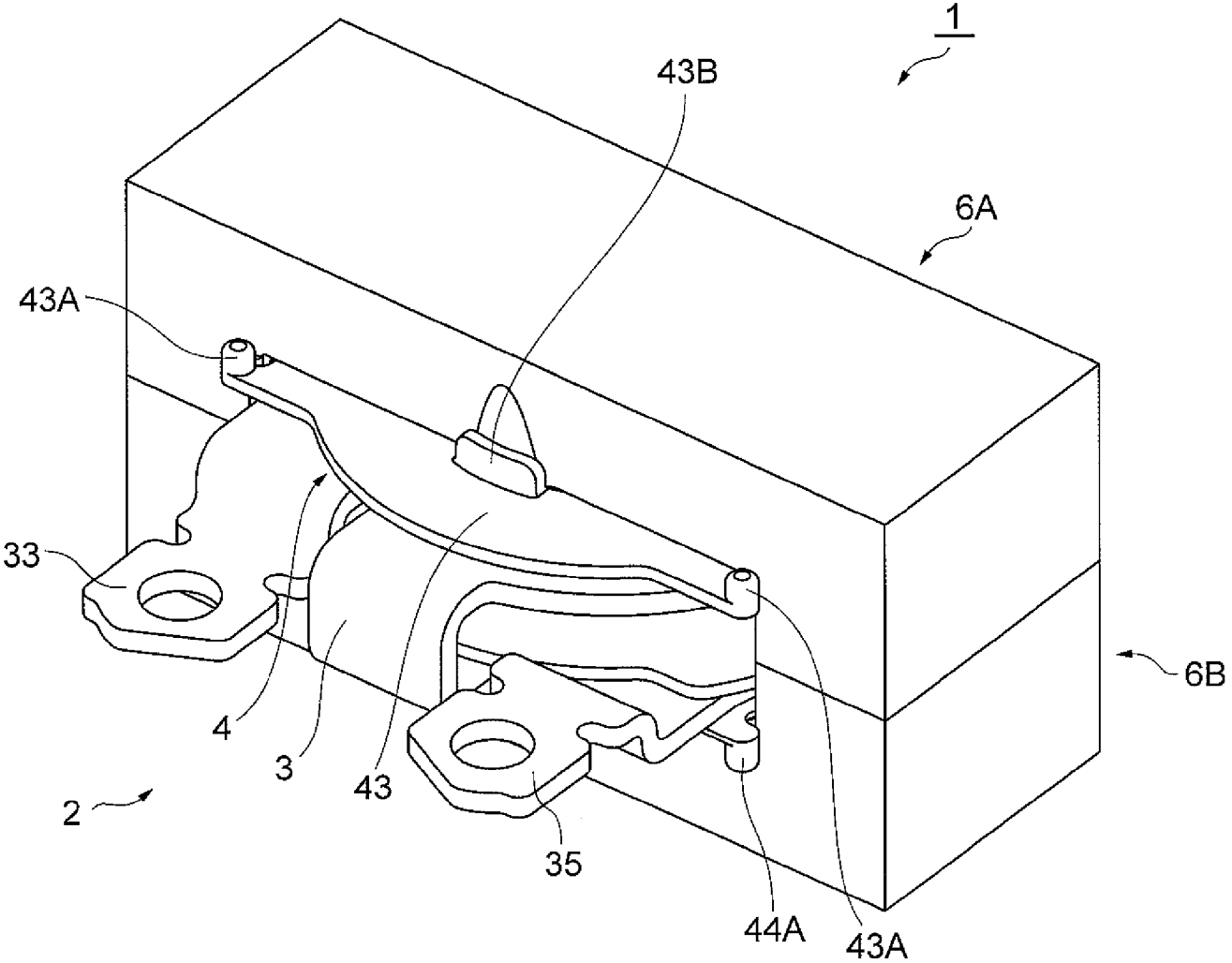
FIG. 1 is a schematic configuration diagram illustrating a transformer that includes a coil component according to an embodiment.

Hereinafter, preferred embodiments of the present invention will be described in detail by referring to the accompanying drawings. Furthermore, the same reference numerals will be given to those of the same components in the description of the drawings, and the description thereof will not be repeated.

(Configuration of Transformer with Coil Component)

Figure 2:
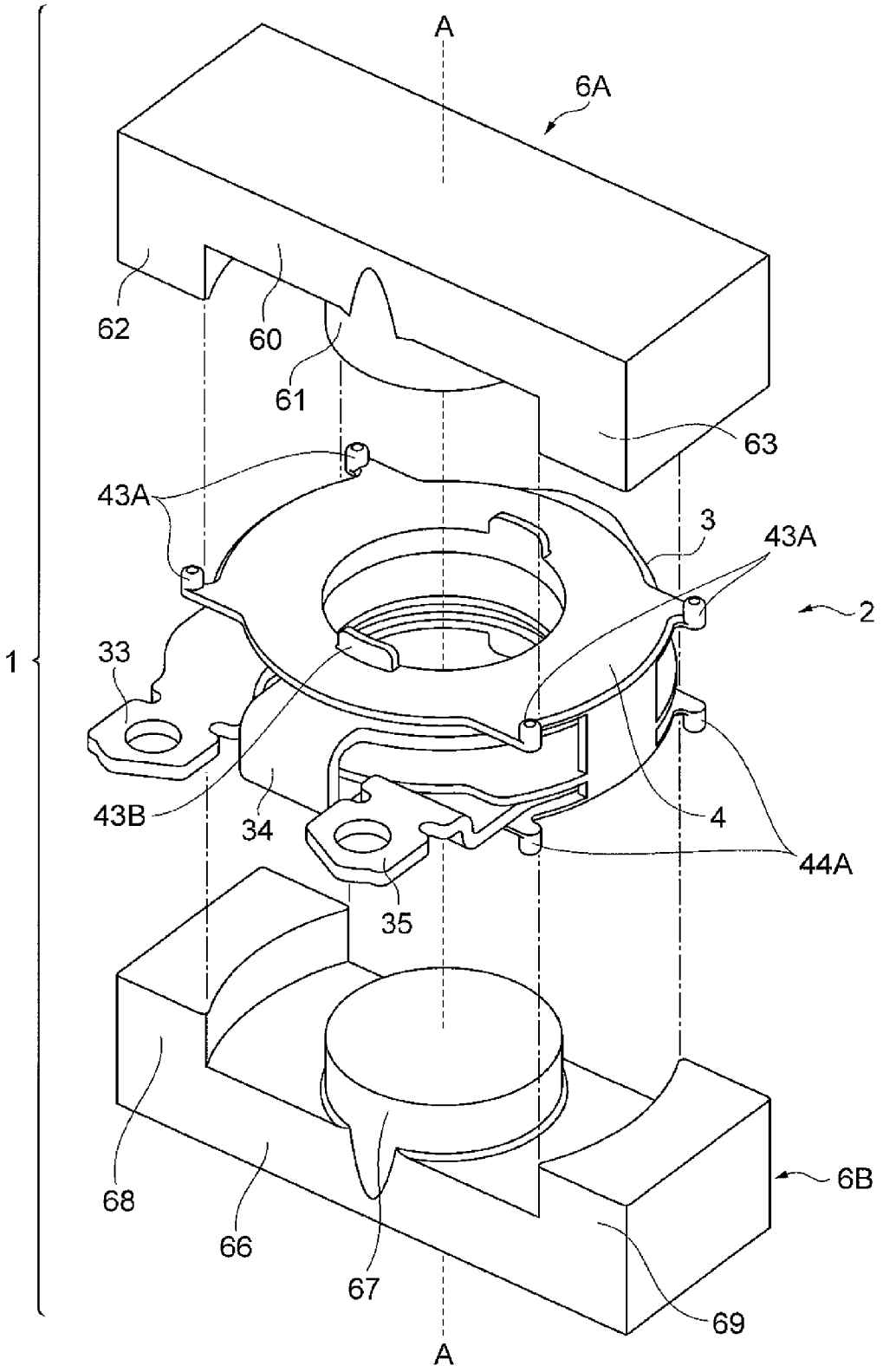
FIG. 2 is an exploded perspective view of the transformer.

Referring to FIGS. 1 and 2, the configuration of a coil component and a bobbin included in the coil component according to the embodiment will be described. FIG. 1 is a schematic configuration diagram illustrating a transformer with the coil component according to the embodiment, and FIG. 2 is an exploded perspective view of the transformer.

A transformer 1 illustrated in FIG. 1 is used in an inductance element, a switching power supply device, a noise filter, an inverter, and the like. The transformer 1 includes a coil component 2 and a pair of magnetic core members 6A and 6B. Further, the coil component 2 includes a coil winding wire 3 and a bobbin 4. The coil winding wire 3 has a configuration in which annular plate-shaped winding members with ends are disposed in parallel with a gap therebetween and are connected to each other in a predetermined direction along the axis A of FIG. 2, and is inserted into the bobbin 4.

Hereinafter, the respective components constituting the transformer 1 will be described, and a method of assembling the transformer 1 will be described.

(Coil Winding Wire)

Figure 3:
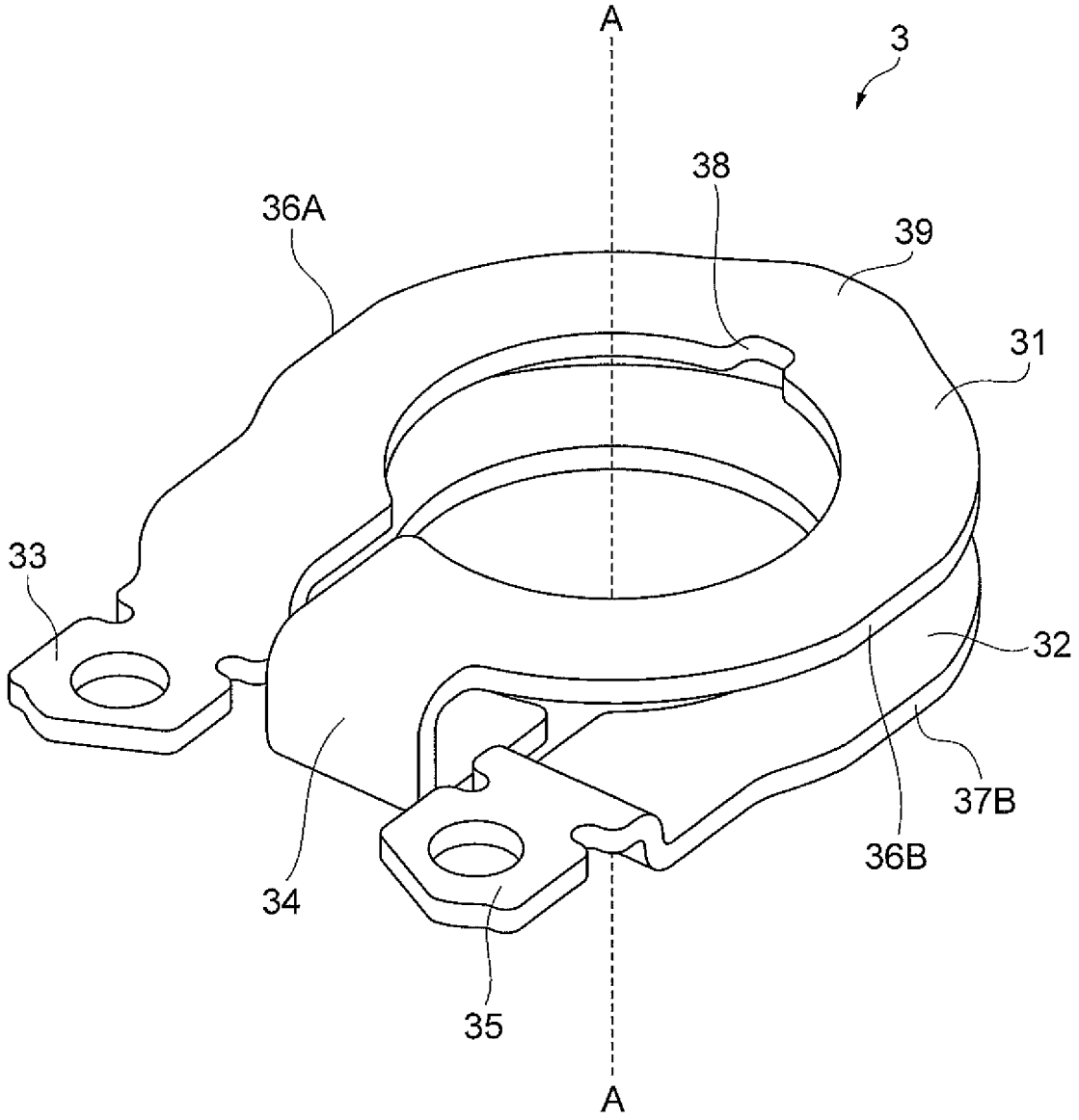
FIG. 3 is a perspective view illustrating the configuration of a coil winding wire.

The coil winding wire 3 will be described by referring to FIGS. 3, 4A, and 4B. FIG. 3 is a perspective view illustrating the configuration of the coil winding wire 3, FIG. 4A is a top view of the coil winding wire 3, and FIG. 4B is a bottom view of the coil winding wire 3.

Figure 4A:
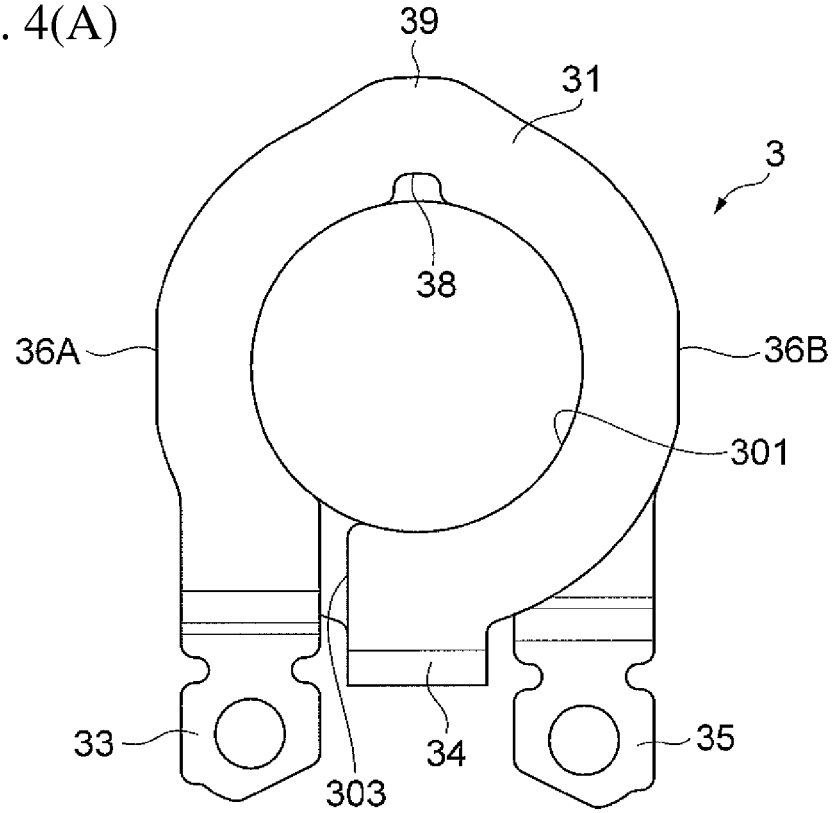
FIG. 4A is a top view of a coil winding wire 3 and FIG. 4B is a bottom view of the coil winding wire 3.
Figure 4B:
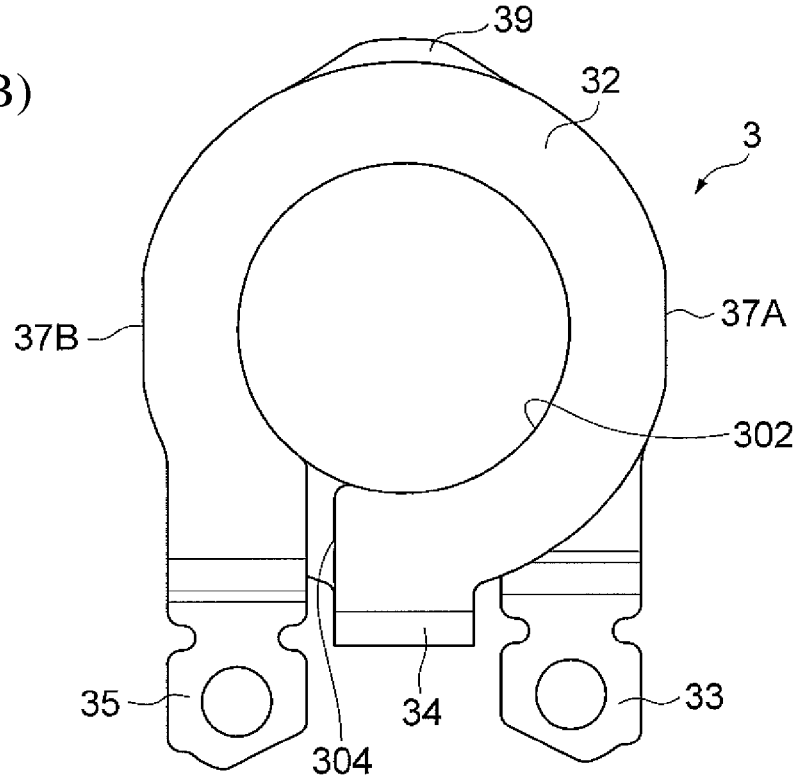

As illustrated in FIGS. 3, 4A, and 4B, the coil winding wire 3 connects two winding members 31 and 32, which are substantially formed in annular shapes with ends and are disposed in parallel with a gap therebetween, in a predetermined direction. The winding members 31 and 32 each having an annular shape with ends substantially form a C-shape and have circular openings 301 and 302 formed at the center portions thereof. The winding member 31 and the winding member 32 overlap each other so that the openings 301 and 302 communicate with each other. Further, the winding member 31 and the winding member 32 are respectively formed as one-turn winding wires, and slits 303 and 304 are respectively formed between one end and the other end so as to extend from the inner periphery to the outer periphery.

Further, one end of the winding member 31 is integrally provided with a first terminal portion 33 that protrudes outward from the axis A (see FIG. 3) of the opening 301. Then, the other end of the winding member 31 is connected to one end of the winding member 32 through a U-shaped connection portion 34. The other end of the winding member 32 is integrally provided with a second terminal portion 35 that protrudes outward from the axis A of the opening 302.

In the coil winding wire 3 with the above-described configuration, the first terminal portion 33 becomes a starting end of the coil winding wire 3, and the second terminal portion 35 becomes a dead end of the coil winding wire 3. Then, when a current is input to the first terminal portion 33, the current flows in order of the winding member 31, the connection portion 34, and the winding member 32 and is output from the second terminal portion 35.

The outer periphery of the winding member 31 of the coil winding wire 3 is provided with notch portions 36A and 36B that are formed by cutting a part of the outer periphery in a linear shape. Similarly, the outer periphery of the winding member 32 is also provided with notch portions 37A and 37B that are formed by cutting a part of the outer periphery in a linear shape. As illustrated in FIGS. 4A and 4B, the notch portion 36A formed in the winding member 31 and the notch portion 37A formed in the winding member 32 overlap each other in a top view. Similarly, the notch portion 36B formed in the winding member 31 and the notch portion 37B formed in the winding member 32 overlap each other in a top view. Further, the notch portions 36A and 36B and the notched portions 37A and 37B are respectively formed at positions with the axis A interposed therebetween so that the respective end surfaces are parallel to one another. Since the coil winding wire 3 is provided with the notch portions 36A, 36B, 37A, and 37B, the distance (the distance between the notch portions 37A and 37B) between the notch portions 36A and 36B becomes the minimum diameter of the winding member 31 (32). That is, the distance (the distance between the notch portions 37A and 37B) between the notch portions 36A and 36B becomes the minimum diameter of the coil winding wire 3.

Further, the inner peripheral edge of the winding member 31 of the coil winding wire 3 is provided with a cut portion 38 that is cut outward from the axis A. The cut portion 38 has a predetermined width along the peripheral edge of the opening 301 and a predetermined depth in the radial direction of the opening 301, and is formed so as to penetrate the winding member 31 in the thickness direction.

Then, since the cut portion 38 is formed, the cross-sectional area of the winding member 31 in a cross-section perpendicular to the current flowing direction around the cut portion 38 decreases, and hence the electrical resistance may increase. Since an increase in electrical resistance may generate heat or the like, there is a need to prevent an increase in electrical resistance. Therefore, in the embodiment, an outer peripheral edge 39 corresponding to the region provided with the cut portion 38 protrudes outward, so that the width of the winding member 31 in the region provided with the cut portion 38 is ensured, and hence an increase in electrical resistance caused by a decrease in the cross-sectional area of the winding member 31 defined by the width and the thickness is suppressed.

The coil winding wire 3 with the above-described configuration may be formed by punching one plate member having high electrical conductivity. More specifically, the first terminal portion 33, the winding member 31 that is continuous to the first terminal portion 33, the second terminal portion 35 that is continuous to the winding member 32, the winding member 32 that is continuous to the second terminal portion 35, and the I-shaped connection portion 34 that connect the winding members 31 and 32 to each other are obtained by punching a plate member such as a copper plate and an aluminum plate. Then, the connection portion 34 is bent in a U-shape so that the winding members 31 and 32 overlap each other with a predetermined gap therebetween. Accordingly, the coil winding wire 3 is finally formed by the conductive plate. Furthermore, the coil winding wire 3 is not limited to the bent coil. For example, the coil member and the connection portion may be screw-clamped or welded to each other. Further, the coil member and the connection portion may be fixed to each other by a rivet.

(Bobbin)

Figure 5A:
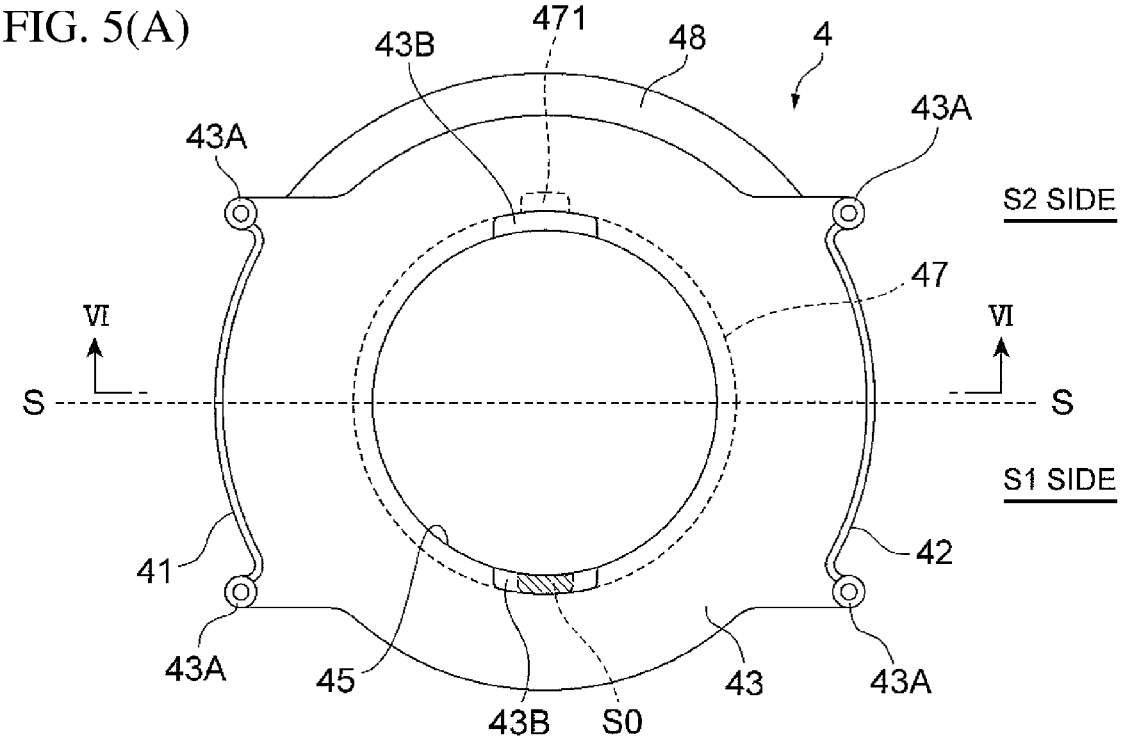
FIG. 5A is a top view of a bobbin and FIG. 5B is a bottom view of the bobbin.
Figure 5B:
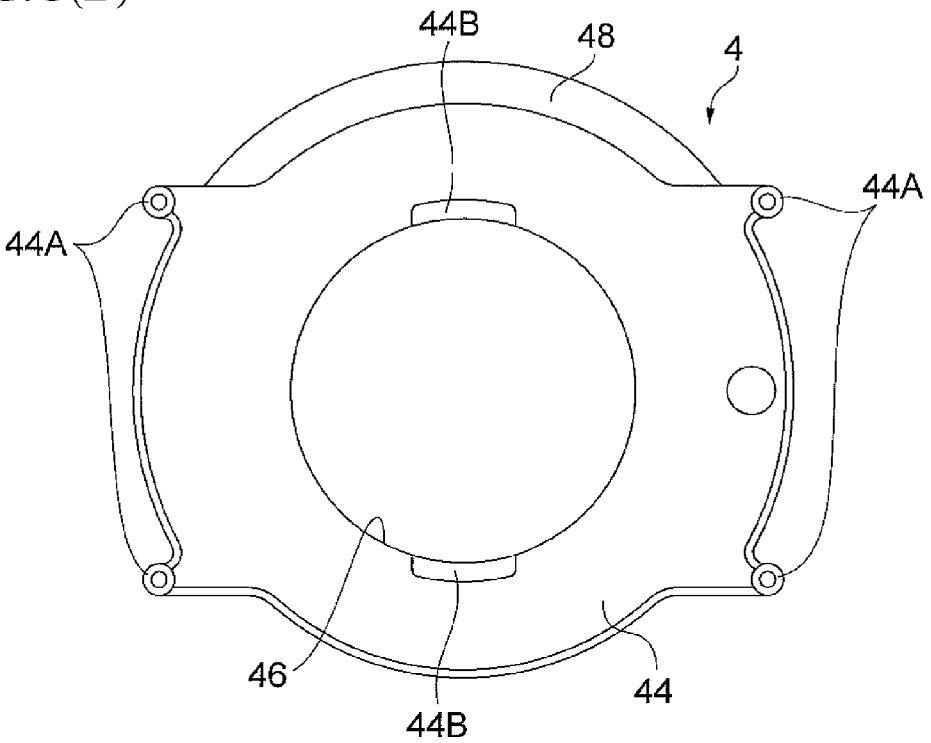
Figure 6:
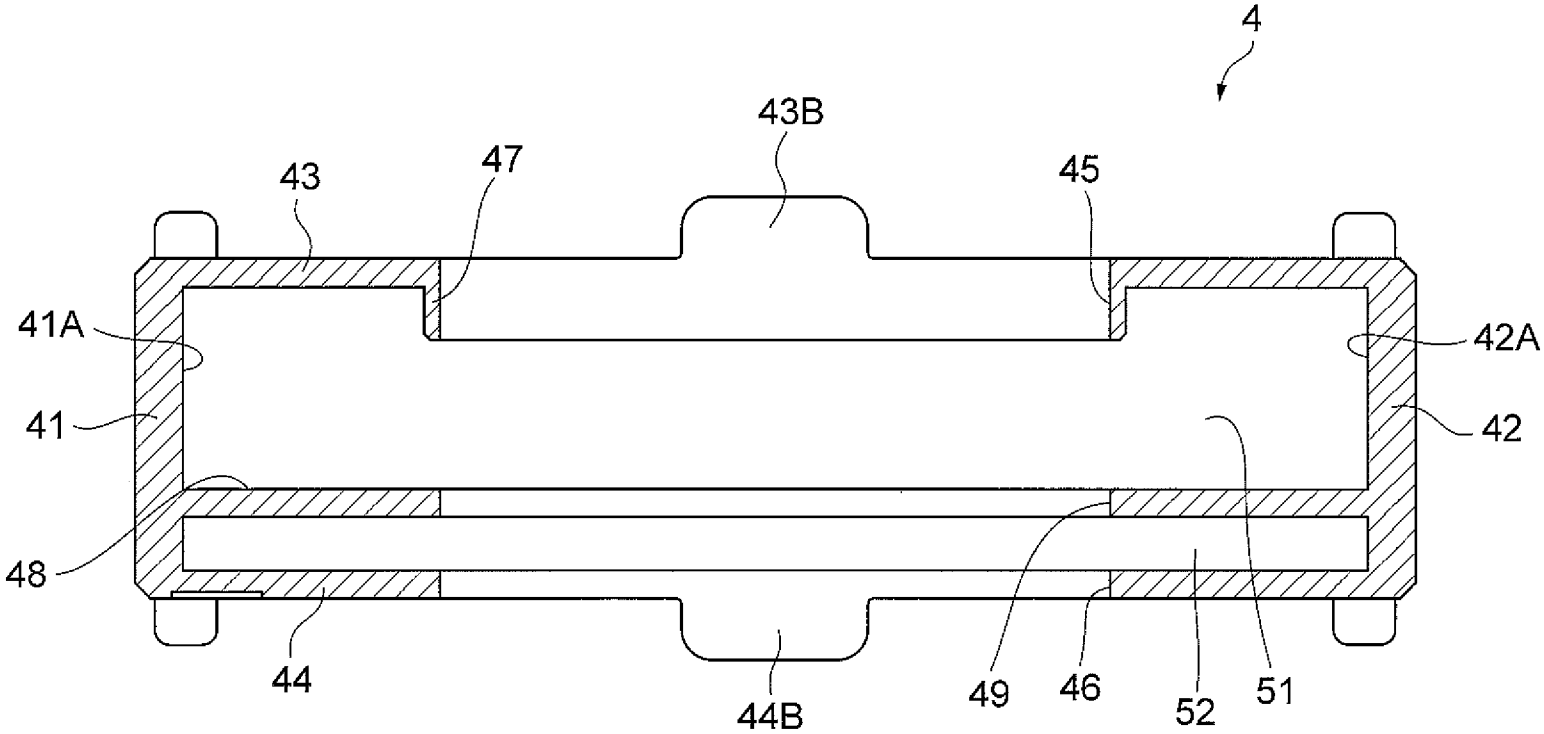
FIG. 6 is a diagram taken along the line VI-VI of FIG. 5A.
Figure 7:
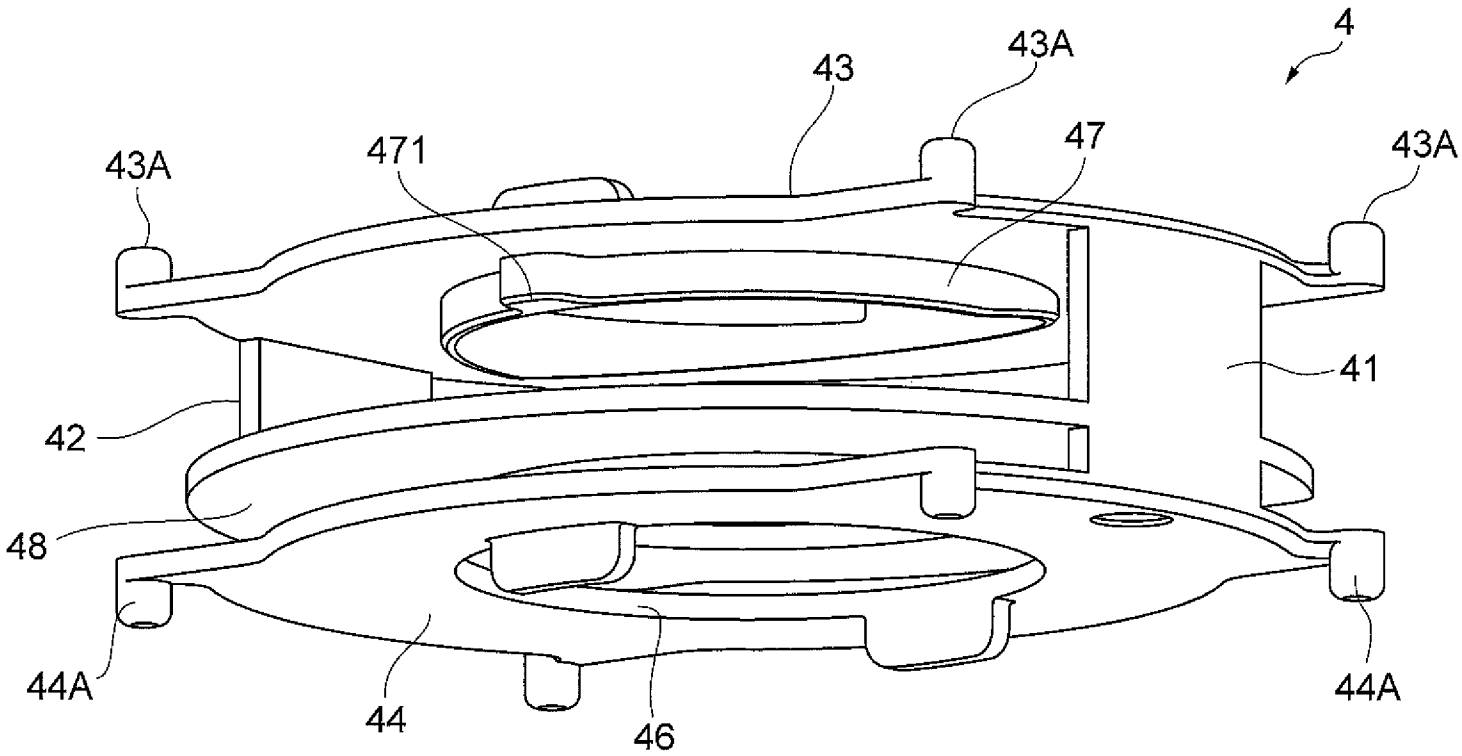
FIG. 7 is a perspective view of the bobbin.

Next, the configuration of the bobbin 4 will be described by referring to FIGS. 5A to 7. FIG. 5A is a top view of the bobbin 4, FIG. 5B is a bottom view of the bobbin 4, FIG. 6 is a diagram taken along the line VI-VI of FIG. 5A, and FIG. 7 is a perspective view of the bobbin 4.

As illustrated in FIGS. 5A to 7, the bobbin 4 includes two side wall portions 41 and 42 that extend in the direction (the up and down direction of FIG. 2) of the axis A of the coil winding wire 3 and are disposed so as to face each other with the axis A interposed therebetween, a connection portion 43 (a first connection portion) that connects the upper ends of the side wall portions 41 and 42 as illustrated in the drawings, and a connection portion 44 (a second connection portion) that connects the lower ends of the side wall portions 41 and 42 as illustrated in the drawings. The side wall portions 41 and 42 and the connection portions 43 and 44 are formed of an insulating material.

The side wall portions 41 and 42 of the bobbin 4 are formed by the members that substantially have flat plate shapes or the same shapes, and are formed so that the length directions thereof become the direction of the axis A of the coil winding wire 3. More specifically, in the side wall portions 41 and 42, the surfaces near the axis A are flat, but the outer peripheral side surfaces opposite to the surfaces near the axis A are gently curved so as to form a circular-arc shape when viewed from the direction of the axis A. Further, the distance between an inner surface 41A of the side wall portion 41 and an inner surface 42A of the side wall portion 42 is set based on the distance (the distance between the notch portions 37A and 37B) between the notch portions 36A and 36B as the minimum diameter of the coil winding wire 3.

Further, the connection portions 43 and 44 are formed by the members having flat plate shapes, are formed in annular shapes having openings 45 and 46 formed at the center portions thereof, and extend in a direction perpendicular to the axis A. The openings 45 and 46 are formed so that the openings communicate with the opening of the coil winding wire 3 and the leg portion of the magnetic core member 6A is insertable into the opening when attaching the coil winding wire 3 to the bobbin 4. Furthermore, the inner diameters of the openings 45 and 46 of the bobbin 4 are set to be smaller than the inner diameter of the opening formed in the coil winding wire 3.

The connection portion 43 of the bobbin 4 is provided with an inner wall portion 47 that extends along the axis A from the inner peripheral edge toward the connection portion 44 disposed at the facing position (where the inner wall portion is indicated by the dashed line in FIG. 5A). The inner wall portion 47 is substantially formed in a substantially annular shape along the peripheral edge of the opening 45. The height of the inner wall portion 47, that is, the length in the direction of the axis A at the lower surface side of the connection portion 43 changes along the peripheral edge of the opening 45 as illustrated in FIG. 7. More specifically, the height of the inner wall portion 47 increases from one side (the side indicated by S1 in FIG. 5A) with respect to the line (the line S in FIG. 5A) connecting the centers of the connection portion 43 and the connection portion 44 toward the other side (the side indicated by S2 in FIG. 5A). Then, in the region S0 which is farthest from the line S at the side S1 of the inner wall portion 47, the height of the inner wall portion 47 is lowest, and the height of the inner wall portion 47 with respect to the lower surface of the connection portion 43 is very low. The height of the region S0 of the inner wall portion 47 may be zero. The slope of the inner wall portion 47 may cause the coil winding wire 3 to be easily inserted into the bobbin 4 when attaching the coil winding wire 3 to the bobbin 4 and prevent the coil winding wire 3 from being separated from the bobbin 4 after attaching the coil winding wire 3 to the bobbin 4. The detail description will be made later.

The width of the inner wall portion 47 that is formed in the connection portion 43 of the bobbin 4 is set to be smaller than a difference between the inner diameter of the opening 45 and the inner diameter of the opening 301 formed in the coil winding wire 3, and is substantially uniform along the peripheral edge of the opening 45. However, a protrusion portion 471 is provided which has a width larger than those of the other regions only in a region of a predetermined length. The length and the depth (width) of the protrusion portion 471 may be defined in correspondence to the cut portion 38 formed in the coil winding wire 3. That is, the protrusion portion 471 is fitted to the cut portion 38 when attaching the coil winding wire 3 to the bobbin 4. Accordingly, it is possible to prevent the rotation of the coil winding wire 3 after attaching the coil winding wire 3 to the bobbin 4. The detail description will be made later.

Further, an intermediate plate portion 48 (a third connection portion) is further provided which connects the inner peripheral surface 41A near the axis A in the side wall portion 41 of the bobbin 4 to the inner surface 42A near the axis A in the side wall portion 42. The intermediate plate portion 48 is formed by a flat plate-shaped member as in the connection portions 43 and 44, forms an annular shape having an opening 49 formed at the center portion thereof, and is formed so as to be parallel to the connection portions 43 and 44. The distance between the intermediate plate portion 48 and the connection portion 44 is set to a thickness in which the winding member of the coil winding wire 3 may be inserted between the intermediate plate portion 48 and the connection portion 44. That is, the intermediate plate portion 48 is used as a winding wire guide that appropriately places the coil winding wire 3 to a predetermined position inside the bobbin 4 when attaching the coil winding wire 3 to the bobbin 4 and is used to prevent the contact and the short-circuit between the winding members of the coil winding wire 3 after the placement.

As in the openings 45 and 46, the opening 49 is formed in the intermediate plate portion 48 of the bobbin 4 so that the opening communicates with the opening of the coil winding wire 3 and the leg portion of the magnetic core member 6A is insertable into the opening when attaching the coil winding wire 3 to the bobbin 4. Furthermore, the inner diameter of the opening 49 of the bobbin 4 is smaller than the inner diameter of the opening formed in the coil winding wire 3.

Further, the connection portions 43 and 44 of the bobbin 4 are integrally provided with guide portions 43A and 44A that protrude outward with respect to the axis A. Further, the connection portion 43 of the bobbin 4 is provided with a second guide portion 43B that extends upward from the upper surface thereof in the direction of the axis A. Further, the connection portion 44 of the bobbin 4 is provided with a second guide portion 44B that extends downward from the lower surface (the bottom surface) thereof in the direction of the axis A. The guide portions 43A and 44A and the second guide portions 43B and 44B prevent the magnetic core member 6A from being moved by the vibration or the like when attaching the magnetic core members 6A and 6B to the coil component 2. The detail description will be made later.

Further, as illustrated in FIG. 6, the region that is surrounded by the side wall portions 41 and 42, the connection portion 43, and the intermediate plate portion 48 forms an opening 51 that has a substantially rectangular shape in a side view. Further, the region that is surrounded by the side wall portions 41 and 42, the connection portion 44, and the intermediate plate portion 48 forms an opening 52 that has a substantially rectangular shape in a side view. At this time, it is desirable that the distance between the side wall portion 41 and the side wall portion 42 be substantially equal to the minimum diameter of the coil winding wire 3.

As an insulating material of forming the bobbin 4, for example, a PBT (Poly Butylene Terephthalate) resin or a PPS (Poly Phenylene Sulfide) resin is appropriately used due to the excellent properties such as heat resistance, chemical resistance, flame resistance, and dimensional stability.

(Attachment of Coil Winding Wire with Respect to Bobbin)

Figure 8:
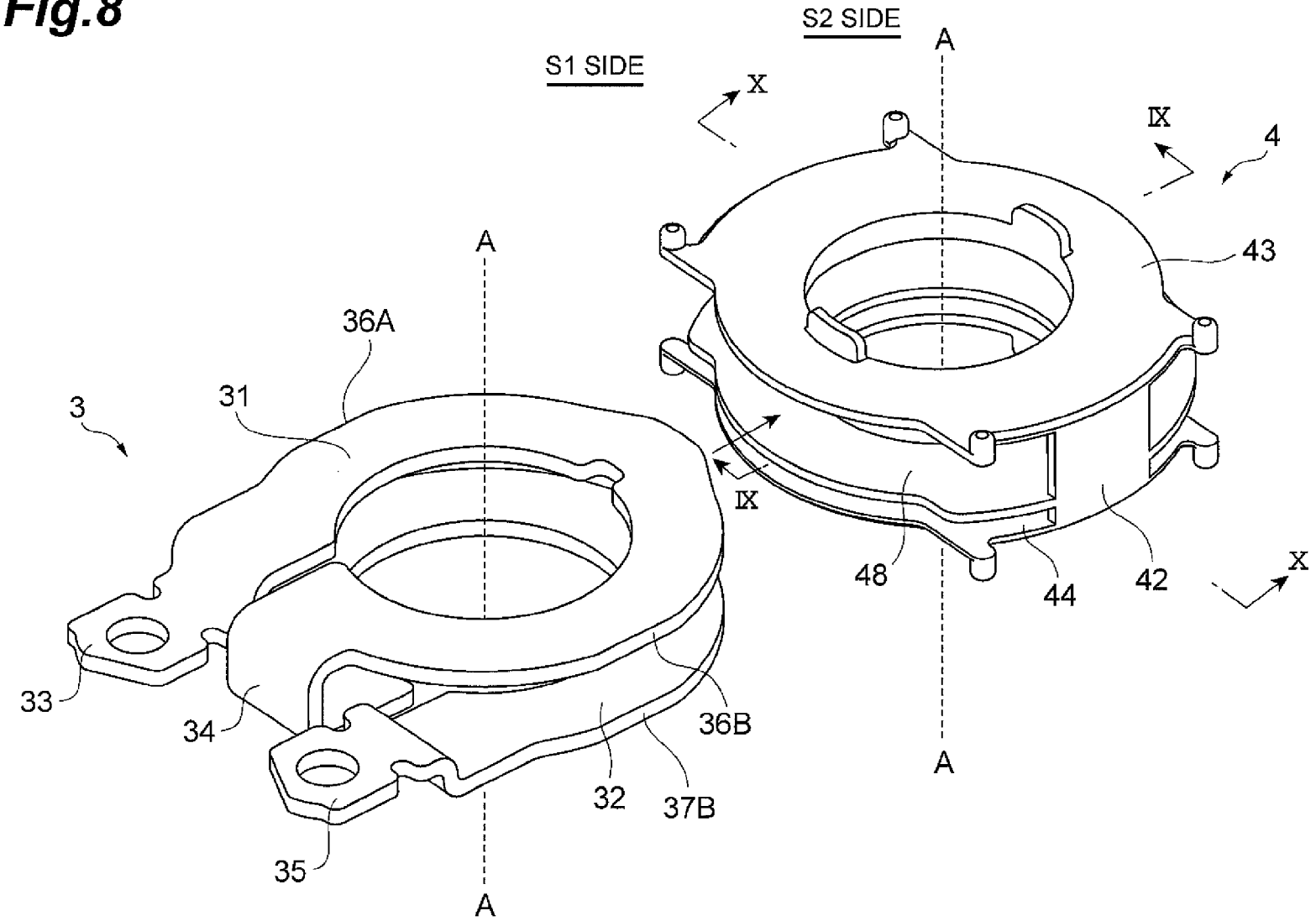
FIG. 8 is a perspective view illustrating a method of attaching the coil winding wire to the bobbin.
Figure 9:
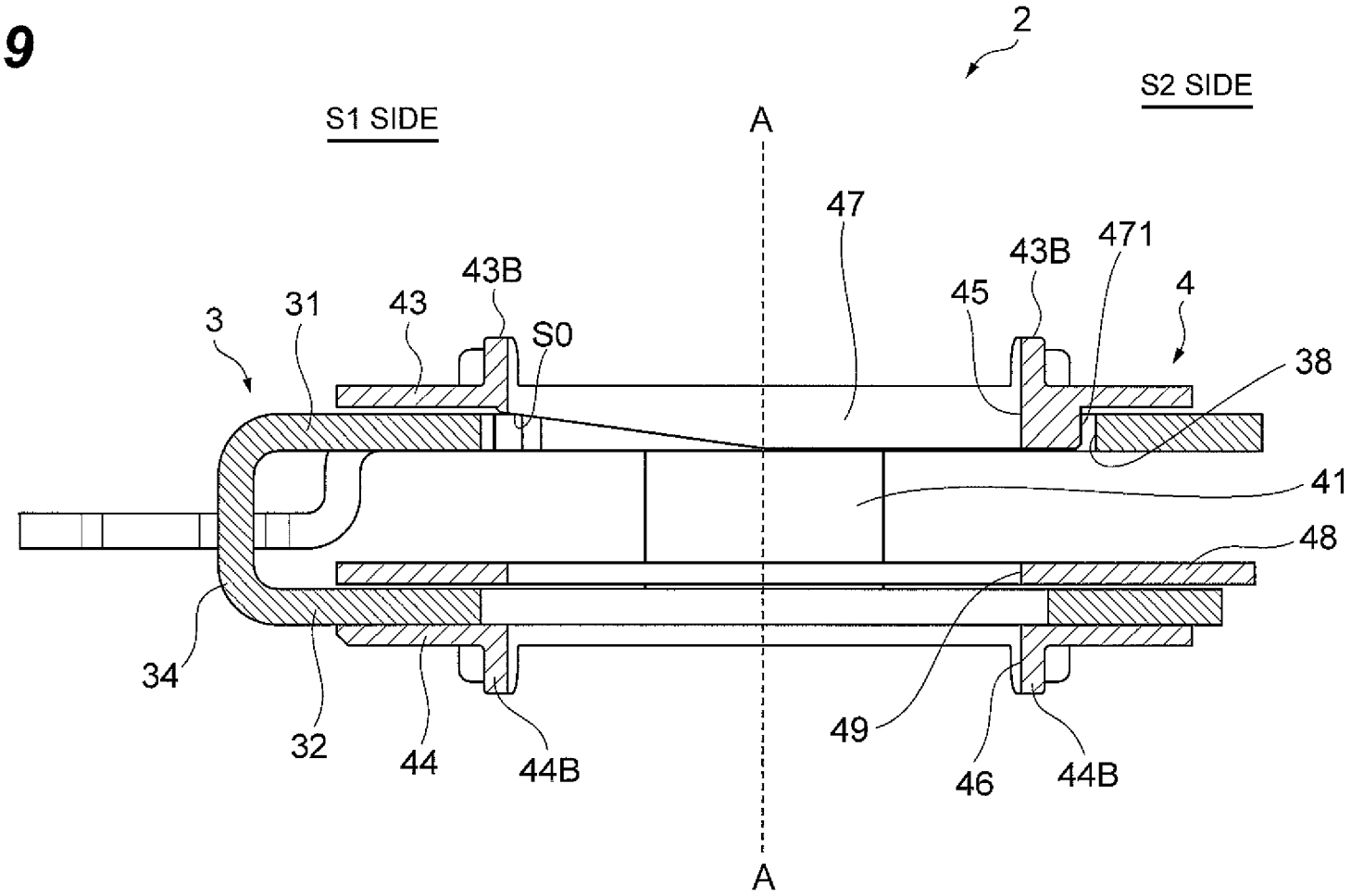
FIG. 9 is a diagram taken along the line IX-IX of FIG. 8 with respect to the attached coil component.
Figure 10:
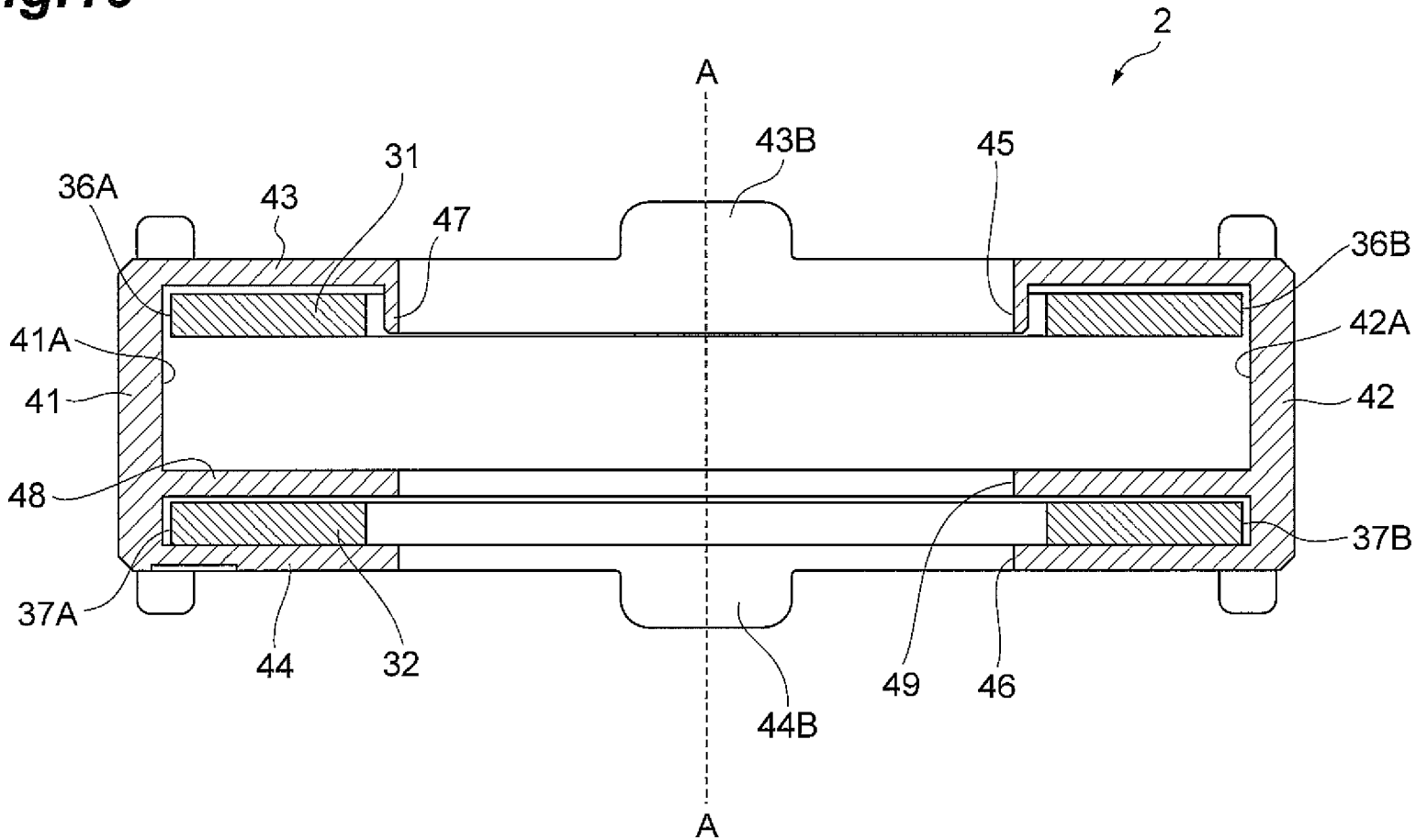
FIG. 10 is a diagram taken along the line X-X of FIG. 8 with respect to the attached coil component.
Figure 11:
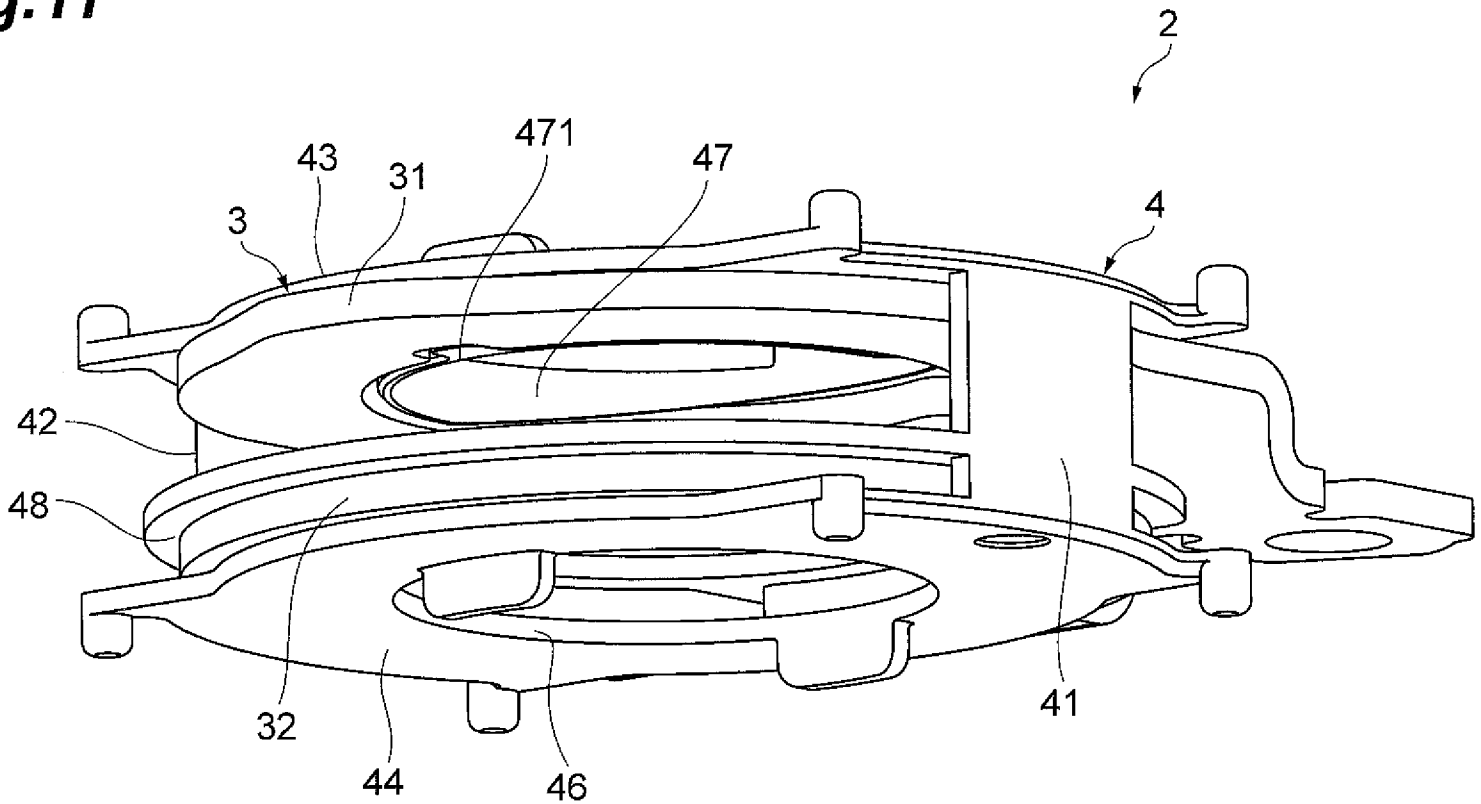
FIG. 11 is a perspective view of the coil component.

Next, the attachment of the coil winding wire 3 with respect to the bobbin 4 will be described by referring to FIGS. 8 to 11. FIG. 8 is a perspective view illustrating a method of attaching the coil winding wire 3 to the bobbin 4. Further, FIG. 9 is a diagram taken along the line IX-IX of FIG. 8 with respect to the attached coil component, and FIG. 10 is a diagram taken along the line X-X of FIG. 8 with respect to the attached coil component. Further, FIG. 11 is a perspective view of the coil component.

As illustrated in FIG. 8, when attaching the coil winding wire 3 to the bobbin 4, the coil winding wire 3 is inserted into the openings (the openings 51 and 52 of FIG. 6) respectively surrounded by the side wall portions 41 and 42 and the connection portions 43 and 44 of the bobbin 4 in a direction from the front side in the drawing toward the inner side in the drawing, that is, a direction from the side S1 of the bobbin 4 toward the side S2. At this time, the coil winding wire 3 is set to a direction in which the communication directions of the openings 45, 46, and 49 of the bobbin 4 matches the axis of the coil winding wire 3 and the notch portions 36A, 36B, 37A, and 37B of the coil winding wire 3 are disposed in the extension direction of the inner surfaces of the side wall portions 41 and 42. Then, the coil winding wire 3 is inserted to a position where the inner surface 41A of the side wall portion 41 faces the notch portions 36A and 37A and the inner surface 42A of the side wall portion 42 faces the notch portions 36B and 37B.

At this time, even when the insertion direction of the coil winding wire 3 with respect to the bobbin 4 is changed by rotating the coil winding wire 3 about the axis A, the coil winding wire 3 may not be inserted into the bobbin because the distance between the side wall portions 41 and 42 is smaller than the diameter of the coil winding wire 3. Specifically, for example, even when there is an attempt to insert the coil winding wire 3 into the bobbin while forming an angle of 45° by the notch portions 36A, 36B, 37A, and 37B and the inner surfaces 41A and 42A of the side wall portions 41 and 42 by rotating the coil winding wire about the axis A by 45°, the coil winding wire 3 may not be inserted between the inner surfaces 41A and 42A of the side wall portions 41 and 42 formed in correspondence with the distance between the notch portions 36A and 36B because the diameter of the winding member 31 in the region without the notch portions 36A and 36B is larger than the distance (the distance between the notch portions 37A and 37B) between the notch portions 36A and 36B.

When inserting the coil winding wire 3 into the bobbin 4, the winding member 31 is inserted into the opening 51 of the bobbin 4, and the winding member 32 is inserted into the opening 52 of the bobbin 4. That is, the bobbin 4 is attached so that the intermediate plate portion 47 is sandwiched between the winding member 31 and the winding member 32.

Here, since the inner wall portion 47 that is formed in the peripheral edge of the opening 45 of the connection portion 43 is formed in a substantially annular shape, it is considered that the coil winding wire 3 may not be easily inserted because the inner wall portion 47 is caught by the winding member 31 of the coil winding wire 3. However, in the bobbin 4 of the embodiment, the inner wall portion 47 is inclined so that the height thereof increases from the region S0 at the side S1 toward the side S2. Accordingly, the height of the inner wall portion 47 contacting the winding member 31 gradually increases from the region S0 as the coil winding wire 3 is inserted into the bobbin 4. Accordingly, the coil winding wire 3 may be inserted into the bobbin 4 while the winding member 31 of the coil winding wire 3 is bent downward about the connection portion 34.

Then, when the coil winding wire 3 is inserted to a position where the communication direction of the openings 45, 46, and 49 of the bobbin 4 matches the axis of the coil winding wire 3, the protrusion portion 471 that is formed in the inner wall portion 47 is inserted into the corresponding cut portion 38 of the coil winding wire 3 as illustrated in FIGS. 9 and 11. Accordingly, the downward bent state of the winding member 31 of the coil winding wire 3 returns to the original state, and the bobbin 4 is attached to a predetermined position of the coil winding wire 3 as illustrated in FIGS. 9 and 10, thereby forming the coil component 2.

After assembling the coil winding wire 3 and the bobbin 4 as the coil component 2, a variation in the positional relation between the coil winding wire 3 and the bobbin 4 is suppressed. For example, since the winding member 32 of the coil winding wire 3 is sandwiched between the connection portion 44 and the intermediate plate portion 48 and the upper surface of the winding member 31 contacts the connection portion 43, the movement of the coil winding wire 3 in the direction of the axis A is suppressed. Further, since the inner wall portion 47 of the bobbin 4 is fitted into the opening 301 of the winding member 31, the movement of the coil winding wire 3 in a plane direction perpendicular to the axis A is suppressed. Moreover, since the cut portion 38 of the winding member 31 is fitted to the protrusion portion 471 formed in the inner wall portion 47 of the bobbin 4, the rotation of the coil winding wire 3 about the axis A is suppressed. In addition, since the distance between the side walls 41 and 42 is set based on the distance (the distance between the notch portions 37A and 37B) between the notch portions 36A and 36B as the minimum diameter of the coil winding wire 3, the rotation of the coil winding wire 3 is also suppressed by the side walls 41 and 42.

Further, the outer peripheral edge 39 includes a portion that is located at the outside in relation to the outer periphery of the connection portion 43 in a top view when the coil winding wire 3 and the bobbin 4 are assembled as the coil component 2. Accordingly, in a case where the coil winding wire 3 and the bobbin 4 are separated from each other so as to rework them, the fitting state between the cut portion 38 and the protrusion portion 471 is released when the outer peripheral edge 39 is pressed downward along the axis A. Further, the coil winding wire 3 and the bobbin 4 may be simply separated from each other when the coil winding wire 3 is pressed toward the region S0. As a result, the disassembling workability is excellent.

(Coil Component)

Next, returning to FIGS. 1 and 2, the transformer 1 will be described. The transformer 1 has a configuration in which the coil component 2 further includes the pair of magnetic core members 6A and 6B.

As illustrated in FIGS. 1 and 2, the magnetic core members 6A and 6B are disposed so as to sandwich the coil component 2 along the axis A penetrating the openings of the coil winding wire 3 and the bobbin 4 constituting the coil component 2.

The magnetic core members 6A and 6B are so-called E-type cores that are obtained by compacting ferrite powder. More specifically, the magnetic core member 6A includes a base portion 60 that has a flat plate shape in the length direction, a columnar main leg 61 that protrudes from the center portion of one main surface of the base portion 60, and two outer legs 62 and 63 that are formed in the ends of the base portion 60 with the main leg 61 interposed therebetween. Further, the magnetic core member 6B includes a base portion 66 that has a flat plate shape in the length direction, a columnar main leg 67 that protrudes from the center portion of one main surface of the base portion 66, and two outer legs 68 and 69 that are formed in the ends of the base portion 66 with the main leg 67 interposed therebetween.

The main leg 61 of the magnetic core member 6 is inserted so as to communicate the openings of the coil component 2, that is, the opening 45 of the connection portion 43 of the bobbin 4, the opening 301 of the winding member 31, the opening 49 of the intermediate plate portion 48 of the bobbin 4, the opening 302 of the winding member 32, and the opening 46 of the connection portion 44 of the bobbin 4. At this time, as illustrated in FIG. 10, since the diameters of the opening 45 of the connection portion 43 of the bobbin 4, the opening 49 of the intermediate plate portion 48, and the opening 46 of the connection portion 44 are smaller than the diameters of the openings 301 and 302 of the winding members 31 and 32, the opening 45 of the connection portion 43, the opening 49 of the intermediate plate portion 48, and the opening 46 of the connection portion 44 are inserted into the main leg 61 of the magnetic core member 6A and the main leg 67 of the magnetic core member 6B with a slight clearance formed therebetween, and the openings 301 and 302 of the winding members 31 and 32 do not contact the main leg 61 of the magnetic core member 6A and the main leg 67 of the magnetic core member 6B. In this way, the bobbin 4 is used to prevent the magnetic core members 6A and 6B from contacting the coil winding wire 3 inside the opening.

Returning to FIG. 1, the outer legs 62 and 63 of the magnetic core member 6A and the outer legs 68 and 69 of the magnetic core member 6B extend in the direction of the axis A so that the outer leg 62 contacts the outer leg 68 and the outer leg 63 contacts the outer leg 69 along the side walls 41 and 42. At this time, since the side wall portions 41 and 42 of the bobbin 4 are formed along the outer peripheral surface of the coil winding wire 3, the side wall portions 41 and 42 serve as insulation members that prevent the magnetic core members 6A and 6B from contacting the coil winding wire 3.

Further, the connection portions 43 and 44 of the bobbin 4 serve as insulation members that prevent the coil winding wire 3 from contacting the magnetic core members 6A and 6B when the coil component 2 is sandwiched between the pair of magnetic core members 6A and 6B.

In addition, the connection portions 43 and 44 of the bobbin 4 are respectively provided with the guide portions 43A and 44A that protrude outward, and the magnetic core members 6A and 6B are attached while the guide portions 43A and 44A contact the outer legs 62, 63, 68, and 69. At this time, the base portions 60 and 66 of the magnetic core members 6A and 6B are respectively sandwiched between the guide portions 43B and 44B. Accordingly, it is possible to suppress a positional deviation in the width direction between the magnetic core members 6A and 6B and the coil component 2. Furthermore, the shapes of the guide portions 43A, 43B, 44A, and 44B are not limited to the above-described shapes, and may be appropriately changed in response to the shape of the magnetic core member. Further, the side wall portions 41 and 42 of the bobbin 4 may be provided with the guide portions.

As described above, according to the bobbin 4 and the coil component 2 including the bobbin 4 and the coil winding wire 3 of the embodiment, in a case where the coil winding wire 3 is inserted into the region formed by two side wall portions 41 and 42 and two connection portions 43 and 44 and the result is sandwiched between the magnetic core members 6A and 6B, it is possible to prevent the two side wall portions 41 and 42 from contacting the coil winding wire 3 and the outer electronic components. Further, since the coil winding wire 3 is sandwiched between the connection portion 43 formed at the upper surface side of the coil winding wire 3 and the connection portion 44 formed at the lower surface side thereof from the upper and lower surfaces of the coil winding wire 3, the insulation property of the coil winding wire with respect to the other electronic components in the up and down direction is also maintained. Further, the inner wall portion 47 that is formed along the opening 45 of the connection portion 43 may be insulated from the leg portions of the magnetic core members 6A and 6B inserted into the opening 45. In addition, since the inner wall portion 47 is inclined so that the height thereof increases from one side (the side S1) facing the line S connecting the centers of the two side wall portions 41 and 42 toward the other side (the side S2), the coil winding wire 3 may be inserted into the bobbin 4 along the slope of the inner wall portion 47, and hence the workability is improved. In this way, according to the bobbin 4 and the coil winding wire 3 of the embodiment, it is possible to improve the insulation property of the coil winding wire without increasing the number of components.

Further, since the bobbin 4 further includes the intermediate plate portion 48 as the third connection portion, it is possible to improve the insulation property between the winding members 31 and 32 by inserting the coil winding wire 3 so that the intermediate plate portion 48 is sandwiched between the winding member 31 and the winding member 32 in the coil winding wire 3 wound by two turns.

Further, since the inner wall portion 47 includes the protrusion portion 471 that protrudes outward in a direction opposite to the axis A, the coil winding wire 3 may be appropriately positioned by the use of the protrusion portion 471. Specifically, since the coil winding wire 3 is provided with the cut portion 38 corresponding to the protrusion portion 471 of the inner wall portion 47 of the bobbin 4, when the coil winding wire 3 and the bobbin 4 are assembled so that the cut portion 28 and the protrusion portion 471 are fitted to each other during the assembly, it is possible to appropriately position the coil winding wire 3 and to prevent the movement of the coil winding wire 3 caused by the vibration or the impact.

While the embodiment of the present invention has been described, the present invention is not limited to the above-described embodiment and may be modified into various forms.

For example, the shapes of the side wall portions 41 and 42, the connection portions 43 and 44, and the intermediate plate portion 48 formed in the bobbin 4 may be appropriately changed. For example, in the bobbin 4 that constitutes the coil component 2 according to the embodiment, a case has been described in which the connection portions 43 and 44 and the intermediate plate portion 48 are all formed in an annular shape, but the connection portion 44 and the intermediate plate portion 48 other than the connection portion 43 provided with the inner wall portion 47 may not be formed in an annular shape, and may be formed as, for example, a rectangular member. That is, the shapes of the connection portions 43 and 44 are not limited to the above-described shapes as long as the connection portions are used to connect the ends of the side wall portions 41 and 42. The "ends" mentioned herein indicate the vicinity of the edges of the side wall portions 41 and 42. Specifically, the side wall portions 41 and 42 may be connected by the connection portions 43 and 44 at the inside of the edges of the side wall portions 41 and 42.

Further, in the embodiment, a case has been described in which the coil winding wire 3 is wound by at least two turns, but the number of turning the coil winding wire may be increased. In this case, the bobbin 4 may further include an insulation member that prevents the contact between the same winding wires in response to the number of turns of the coil winding wire.

Further, the protrusion portion 471 that is formed in the inner wall portion 47 of the bobbin 4 is not essentially needed in the bobbin 4. Further, in a case where the protrusion portion 471 is not formed in the inner wall portion 47 of the bobbin 4, the coil winding wire 3 does not need to be provided with the cut portion 38.

Further, in the above-described embodiment, a case has been described in which the connection portions 43 and 44 of the bobbin 4 are formed in annular shapes, but the shapes of the connection portions 43 and 44 are not limited to the above-described shapes as long as the connection portions are used to connect the ends of the side wall portions 41 and 42. The "ends" mentioned herein indicate the vicinity of the edges of the side wall portions 41 and 42. That is, the side wall portions 41 and 42 may be connected by the connection portions 33 and 34 at the inside of the edges of the side wall portions 41 and 42.

Further, in the coil component 2 of the above-described embodiment, a configuration has been described in which one coil winding wire as the coil winding wire 3 is attached to the bobbin 4, but the number of the coil winding wires may be two or more and the number of winding the coil winding wire may be one turn or more. Furthermore, the shape of the winding member forming the coil winding wire is not limited to the annular shape with ends, but may be, for example, a shape of an edgewise coil. Further, in the above-described embodiment, the annular coil winding wire has been described, but the shape of the coil winding wire may be formed in, for example, a rectangular shape in which an opening is formed at the center portion thereof. That is, the shape of the coil winding wire is not particularly limited as long as the coil winding wire may be inserted into the bobbin 4.

Further, in the coil component 2 of the above-described embodiment, the side wall portions 41 and 42 are formed at the positions corresponding to the outer legs of the magnetic core members 6A and 6B, but the side wall portions 41 and 42 may be formed at different positions from this arrangement.

Further, in the bobbin 4 of the above-described embodiment, the inner wall portion 47 is inclined so that the height thereof gradually increases from the region S0 at the side S1 toward the side S2 as a whole, but the present invention is not limited thereto. For example, only a part of the inner wall portion 47 may increase in height from one side toward the other side. As such a configuration, for example, a configuration may be exemplified in which the inner wall portion is formed flatly from the region S0 toward the middle of the region S1 and is inclined at an angle larger than the inclination angle of the embodiment therefrom. That is, a part of the inner wall portion 47 from the region S0 toward the middle of the side S1 is inclined and the other side S1 or the side S2 is formed flatly. Further, the inner wall portion may be increased in height so as to be inclined at an inclination gentler than that of the embodiment from the side S0 toward the side S2.

Further, the shapes of the pair of magnetic core members 6A and 6B are not limited to the so-called EE-shape illustrated in the above-described embodiment. As other shapes of the core member, for example, an BE-shape, an UI-shape, and the like may be exemplified. Further, an air core without a main leg and an outer leg may be used.

Further, in the above-described embodiment, a case has been described in which the coil component 2 is used in the transformer 1, but the coil component according to the embodiment may be applied to other electronic components such as a choke coil.

What is claimed is:

1. A bobbin comprising:

at least two insulating side wall portions that are disposed so as to face each other with an axis interposed therebetween and extend in the axis direction;

a first insulating connection portion that is formed along a plane perpendicular to the axis so as to connect the same side ends in the axis extension direction among the ends of the two side wall portions and has an opening formed in a region with the axis; and a second insulating connection portion that is formed along a plane perpendicular to the axis so as to connect the opposite side ends of the ends connected by the first connection portion among the ends of the two side wall portions, wherein the first connection portion includes an inner wall portion that is formed in a surface facing the second connection portion so as to extend in the axis direction from the peripheral edge of the opening, and wherein the inner wall portion in the axis direction is inclined so that the height thereof increases from one side toward the other side.

2. The bobbin according to claim 1, further comprising:

a third insulating connection portion that is formed in a plane perpendicular to the axis so as to connect the two side wall portions at a position different from both ends of the two side wall portions.

3. A coil component comprising:

a coil winding wire that is wound around the axis by at least one turn; and the bobbin according to claim 2.

4. The bobbin according to claim 2, wherein the inner wall portion includes a protrusion portion that protrudes outward.

5. The bobbin according to claim 1, wherein the inner wall portion includes a protrusion portion that protrudes outward.

6. A coil component comprising:

a coil winding wire that is wound around the axis by at least one turn; and the bobbin according to claim 5, wherein the coil winding wire is formed by connecting a plurality of plate-shaped winding wires in the axis direction, forms an annular shape when viewed from the axis direction, and has a cut portion that is formed at the inner peripheral side thereof so as to protrude outward from the axis, and wherein the shape of the cut portion corresponds to the protrusion portion that is formed in the inner wall portion of the bobbin.

7. A coil component comprising:

a coil winding wire that is wound around the axis by at least one turn; and the bobbin according to claim 1.

* * * * *